US011571020B2

(12) United States Patent
Barry

(10) Patent No.: US 11,571,020 B2
(45) Date of Patent: Feb. 7, 2023

(54) CIGARETTE PAPER DISPENSER

(71) Applicant: Thomas Barry, Dublin (IE)

(72) Inventor: Thomas Barry, Dublin (IE)

( * ) Notice: Subject to any disclaimer, the term of this patent is extended or adjusted under 35 U.S.C. 154(b) by 540 days.

(21) Appl. No.: 16/624,821

(22) PCT Filed: Jun. 20, 2018

(86) PCT No.: PCT/EP2018/066392
§ 371 (c)(1),
(2) Date: Dec. 19, 2019

(87) PCT Pub. No.: WO2018/234373
PCT Pub. Date: Dec. 27, 2018

(65) Prior Publication Data

US 2020/0113229 A1 Apr. 16, 2020

(30) Foreign Application Priority Data

Jun. 21, 2017 (GB) ..... 1709937

(51) Int. Cl.

| | |
|---|---|
| ***A24F 17/00*** | (2006.01) |
| ***B65D 65/12*** | (2006.01) |
| ***B65D 83/08*** | (2006.01) |
| *B65D 85/10* | (2006.01) |

(52) U.S. Cl.
CPC ..... *A24F 17/00* (2013.01); *B65D 65/12* (2013.01); *B65D 83/0805* (2013.01); *B65D 85/10* (2013.01)

(58) Field of Classification Search
CPC ..... B65D 5/2042; B65D 5/241; B65D 85/10; B65D 83/0805; B65D 65/12; A24F 23/04; A24F 17/00; A24C 5/44
USPC ..... 206/494, 256; 229/115
See application file for complete search history.

(56) References Cited

U.S. PATENT DOCUMENTS

| | | | | |
|---|---|---|---|---|
| 2006/0243610 | A1* | 11/2006 | Chamami | A24F 17/00 206/242 |
| 2015/0014193 | A1* | 1/2015 | Zeier | B65D 83/0805 206/271 |
| 2016/0128382 | A1* | 5/2016 | Staiano | A24F 23/04 206/256 |
| 2019/0183165 | A1* | 6/2019 | Haddad | B65D 5/2042 |

FOREIGN PATENT DOCUMENTS

| | | | |
|---|---|---|---|
| EP | 1155974 | A1 | 11/2001 |
| EP | 2387891 | A1 | 11/2011 |
| EP | 2423128 | A1 | 2/2012 |
| EP | 3135130 | A1 | 3/2017 |

(Continued)

OTHER PUBLICATIONS

International Search Report dated Sep. 27, 2018, Applicant: Barry, Thomas, PCT Application No. PCT/EP2018/066392 filed Jun. 20, 2018.

(Continued)

*Primary Examiner* — King M Chu
(74) *Attorney, Agent, or Firm* — Shumaker, Loop & Kendrick, LLP; Jeffrey B. Fabian

(57) ABSTRACT

A cigarette paper dispenser comprising a structure foldable between a first and second configuration, the first configuration forming a tray; and the second configuration forming a pouch for carriage of a rolled cigarette.

8 Claims, 6 Drawing Sheets

(56) References Cited

FOREIGN PATENT DOCUMENTS

| | | | |
|---|---|---|---|
| ES | 1157408 | U | 5/2016 |
| FR | 3007946 | A1 | 1/2015 |
| GB | 2534843 | A | 8/2016 |
| WO | 2004/084659 | A1 | 10/2004 |
| WO | 2010/144063 | A1 | 12/2010 |

OTHER PUBLICATIONS

Combined Search and Examination Report dated Oct. 2, 2017, Applicant: Barry, Thomas, GB Application No. GB1709937.5, filed Jun. 21, 2017.

* cited by examiner

CIGARETTE PAPER DISPENSER

CROSS-REFERENCE TO RELATED APPLICATIONS AND PRIORITY

The present application claims priority from International Application No. PCT/EP2018/066392, filed on Jun. 20, 2018 which claims priority to Great Britain Application No GB1709937.5 filed on Jun. 21, 2017, both of which are hereby expressly incorporated by reference in entirety.

TECHNICAL FIELD AND BACKGROUND

This invention relates to a cigarette paper dispenser. In particular, a cigarette paper dispenser foldable into different configurations.

Cigarette smoking remains a popular pastime. Rather than smoking commercially available pre-rolled varieties of cigarettes, many smokers prefer to fashion their own cigarettes by surrounding tobacco or other substances of their preference in rolled tobacco papers. To this end, there exists pre-packaged rolling or cigarette papers. These generally comprise a rectangular sheet of paper with a bisecting fold along the length of the paper. A filling of tobacco or other substances is placed by the smoker along the fold. The fold is then pinched between the fingers of the smoker and the paper is subsequently rolled about the filling. Once the smoker is satisfied that the filling is adequately distributed within the paper, the paper may be wrapped about the filling and sealed, normally by pressing along the length of the paper over a gummed or otherwise lightly adhesive strip along one side of the paper. A smoker may also place a filter or paper tip at one end of the cigarette to facilitate inhalation from the cigarette.

It should be noted that the satisfactory rolling of a cigarette as described above requires a manner of skill on behalf of the smoker. The construction of the cigarette can be aided by having a suitable surface to procure the tobacco or other filling substance from a larger bulk and to distribute the filling within the paper prior to the subsequent rolling.

A dispenser which further provided assistance for the rolling of a cigarette and provided for carriage of a rolled cigarette would be an improvement on the state of the art.

SUMMARY

An embodiment of the present invention includes a cigarette paper dispenser comprising a structure foldable between a first and second configuration: the first configuration forming a tray; and the second configuration forming a pouch or enclosure for carrying a rolled cigarette.

The dispenser comprises a structure foldable between the two configurations thus facilitating the construction and carriage of rolled cigarettes. The device is foldable to provide an integrated solution to the fabrication and transport of rolled cigarettes.

The dispenser provides papers required for rolling a cigarette and the first configuration provides a tray surface which aids in the construction of a rolled cigarette. This prevents the smoker, for example, having to rest papers and tobacco in their lap. The pouch provides a useful receptacle to house a rolled cigarette when it is not desirable or not possible to smoke the rolled cigarette immediately upon fabrication. This prevents, for example, a rolled cigarette becoming crushed in a pocket.

The structure may further comprise a plurality of panels foldable along hinge lines adjoining the panels. This is advantageous as it provides for a simple and intuitive construction which allows a user to easily fold the structure between configurations.

In the first configuration the structure may comprise a substantially "M" shaped profile and in the second configuration the structure may form a substantially triangular shaped prism. This is advantageous as the "M" shaped profile of the tray provides an effective surface for the placement of tobacco or other filling substance within the rolling paper. For example, if the rolling paper is placed with its bisecting fold along the groove formed at the centre of the "M" shape, tobacco may be easily placed and very effectively distributed along the length of the rolling paper. The triangular prism shape is advantageous as it provides a strong structure which can retain a cigarette within its core. The triangular prism shape provides sufficient rigidity to resist crushing even if the dispenser receives knocks or blows. Thus, a cigarette placed within its core is protected.

The plurality of panels may comprise at least a first and a second cover panel and at least a first and a second inner panel. This provides for a simple construction and furthermore providing at least four panels in this manner, i.e. the first and second cover panels; and the first and second inner panels, provides four surfaces which can be easily folded by the user into the "M" shaped profile of the tray. Furthermore, the cover panels provide additional protection to the cigarette paper dispenser.

The first inner panel may be adjoined to the second inner panel along a first foldable hinge line along the length of the panels. This provides for formation of the centre of the "M" shape such that tobacco may be easily placed and very effectively distributed along the length of the rolling paper.

The first inner panel may be adjoined to the first cover panel along a second foldable hinge line along the length of the panels and the second inner panel may be adjoined to the second cover panel along a third foldable hinge line along the length of the panels. This provides for a simple foldable construction along a single foldable axis. Again, this is advantageous as it provides an intuitive construction which allows a user to easily fold the structure between configurations.

At least one of the plurality of panels may further comprise a pouch foldable between a closed configuration wherein the pouch is substantially flat and an open configuration forming a void for carriage of a rolled cigarette. This is advantageous as it provides that the dispenser is compact when it is in a fully closed configuration as the pouch will be substantially flat. It also provides that the pouch may remain flat when the structure is in the first configuration, forming the tray, such that the pouch does not interfere with the tray. Furthermore, it provides that when the pouch is in the open configuration, a volume or void is created in the structure which provides sufficient space for a rolled cigarette to be placed.

The pouch may comprise a pair of foldable collars which are substantially flat in the closed configuration and form end walls of the pouch in the open configuration. This is advantageous as once again, allowing the pouch to be substantially flat in the closed configuration provides for a compact construction while forming end walls in the open configuration prevents a rolled cigarette from falling out of the ends of the structure.

With the pouch in the open configuration, the plurality of panels may be foldable about the pouch to seal the void for carriage of a rolled cigarette. This is advantageous as it provides a sealed prism shape to protect the cigarette and prevent it from falling out of the structure.

The cigarette paper dispenser may further comprise a magnetic clasp to retain the pouch in the closed configuration. This further ensures that the pouch may remain flat when the structure is in the first configuration, forming the tray, such that the pouch does not interfere with the tray.

The cigarette paper dispenser may further comprise an elasticated means to retain the structure in the second configuration. It is advantageous to retain the structure in the second position when a cigarette is placed within the pouch to prevent the pouch from opening and thus prevent the cigarette from falling from the structure.

DETAILED DESCRIPTION

Figure 1:
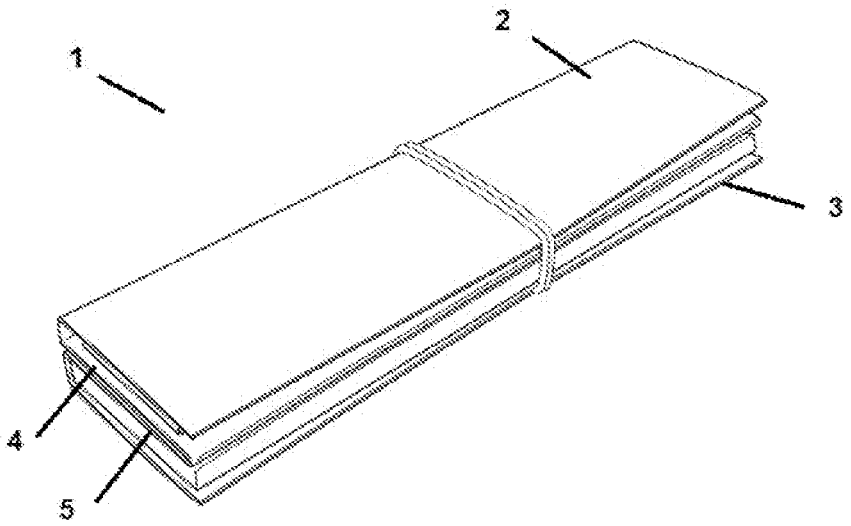
FIG. 1 is a front view of a cigarette dispenser according to one embodiment of the invention in a closed configuration.
Figure 2:
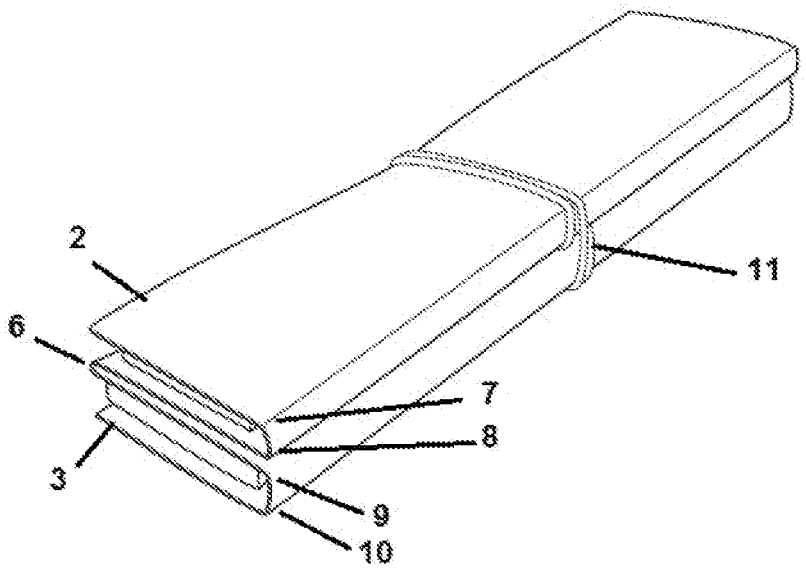
FIG. 2 is a rear view of a cigarette dispenser according to one embodiment of the invention in a closed configuration.

FIG. 1 is a front view of the cigarette dispenser in a closed configuration while FIG. 2 is a rear view of the cigarette dispenser of the invention in a closed configuration. In this configuration, the dispenser is substantially flat in profile. The structure 1 of the dispenser comprises a plurality of panels 2, 3, 4, 5 foldable along hinge lines 6, 7, 8, 9, 10 adjoining the panels. From FIGS. 1 and 2, it can be seen that in the closed configuration, a first cover panel 2 and a second cover panel 3 are outward of the structure. The structure is retained in this configuration by an elasticated means, such as an elasticated band 11, wrapped around the structure.

Figure 3:
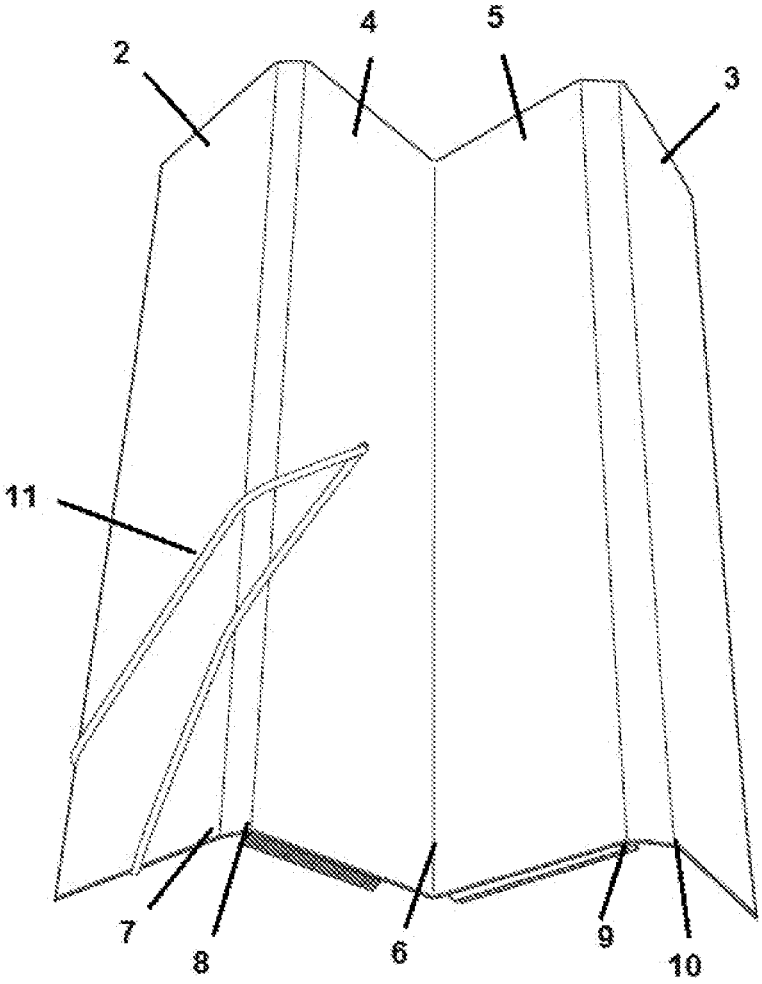
FIG. 3 is a front view of a cigarette dispenser according to one embodiment of the invention in the first or tray configuration.

FIG. 3 is a topside view of the cigarette dispenser 1 according to one embodiment of the invention folded into a first configuration or tray configuration. The first configuration the structure comprises a substantially "M" shaped profile. The "M" shaped profile is formed from the surfaces of the plurality of panels 2, 3, 4, 5 of the structure. The M shaped profile comprises the first cover panel 2, the second cover panel 3 and a first inner panel 4 and a second inner panel 5. The first inner panel 4 is adjoined to the second inner panel 5 along a first foldable hinge line 6 along the length of the panels. Furthermore, the first inner panel is adjoined to the first cover panel along second foldable hinge lines 7, 8 along the length of the panels and the second inner panel is adjoined to the second cover panel along third foldable hinge lines 9, 10 along the length of the panels.

The elasticated band 11 extends from a central area of the first inner panel 4 and may be stretched to hook over a corner of the first cover panel 2 when the structure is in the tray configuration.

Figure 4:
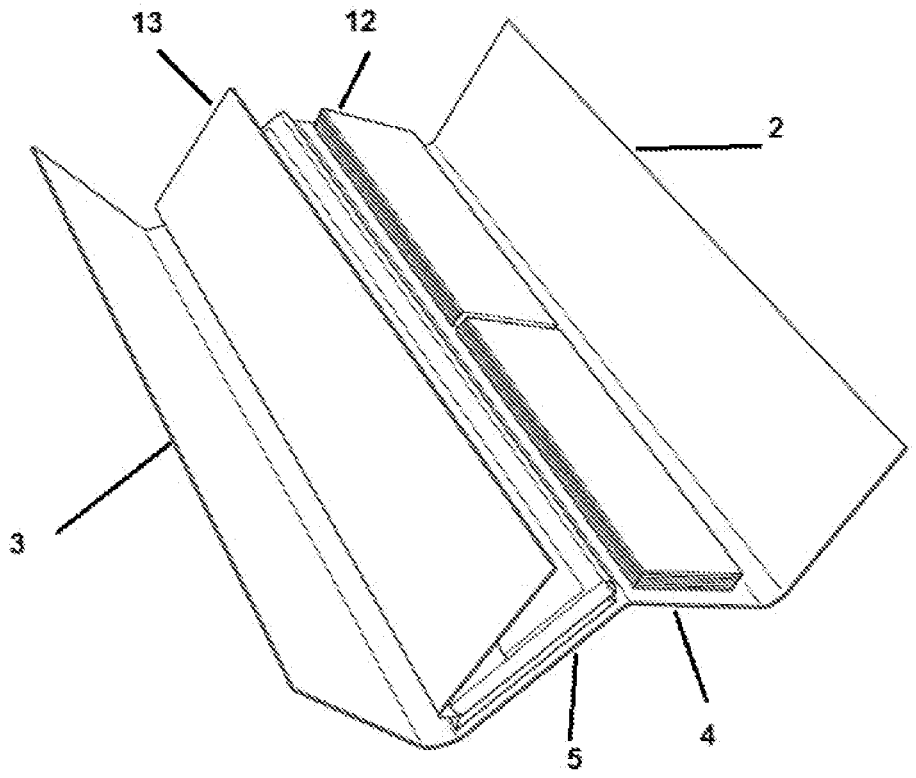
FIG. 4 is a view of a cigarette dispenser according to one embodiment of the invention showing the dispensing means and cigarette tips.
Figure 5:
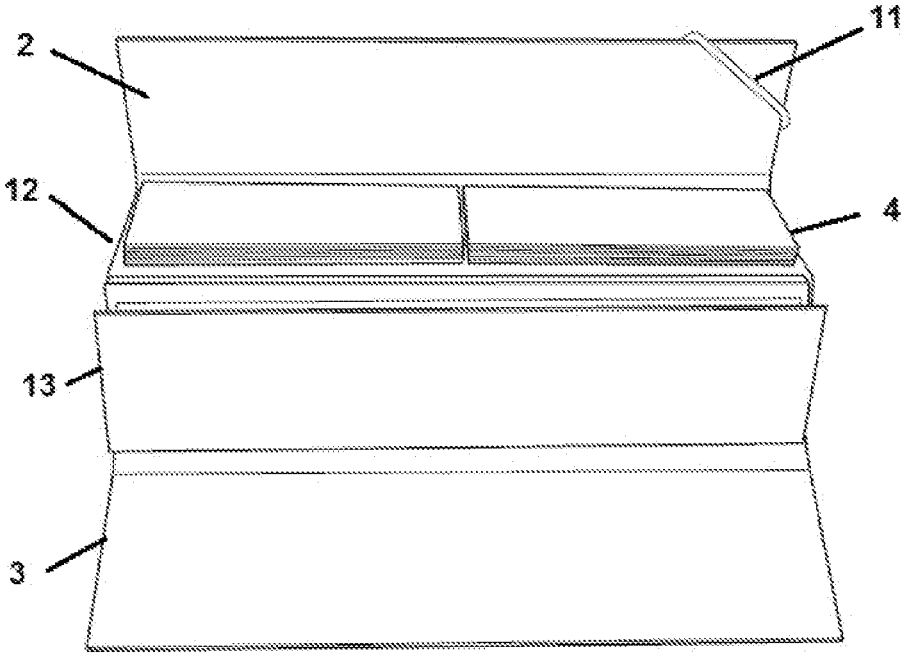
FIG. 5 is a front view of a cigarette dispenser according to one embodiment of the invention being folded towards the second configuration.

FIGS. 4 and 5 are underside views of the cigarette dispenser of the invention when folded into the first configuration or tray configuration and showing a plurality of cigarette tips 12 fixed to the underside of the first inner panel 4 and a dispensing means or holder 13 for rolling papers fixed to the underside of the second inner panel 5. Thus, the required paraphernalia for rolling a cigarette are affixed to the structure 1 and available to the smoker.

Figure 6:
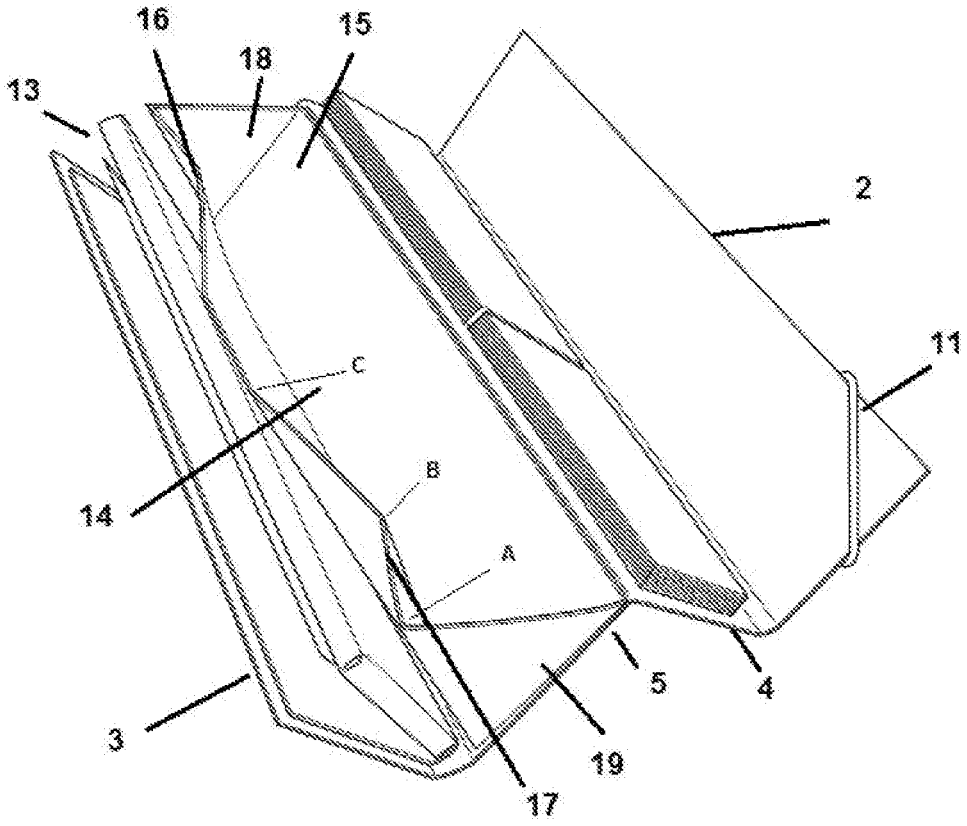
FIG. 6 is a front view of a cigarette dispenser according to one embodiment of the invention being further folded towards the second configuration.

FIG. 6 is a front view of the cigarette dispenser of the invention being folded towards the second or pouch configuration, the second configuration forming a pouch 14 for carriage of a rolled cigarette. The pouch 14 is formed between the underside of the dispensing means 13 and the underside of the second inner panel 5. The pouch 14 is foldable between a closed configuration wherein the pouch 14 is substantially flat (as in FIGS. 4 and 5 and an open configuration forming a void 15 for carriage of a rolled cigarette (as in FIG. 6).

The pouch 14 comprises a pair of foldable collars 16, 17. These collars 16, 17 are substantially flat in the closed configuration and form end walls 18, 19 of the pouch in the second configuration.

Figure 7:
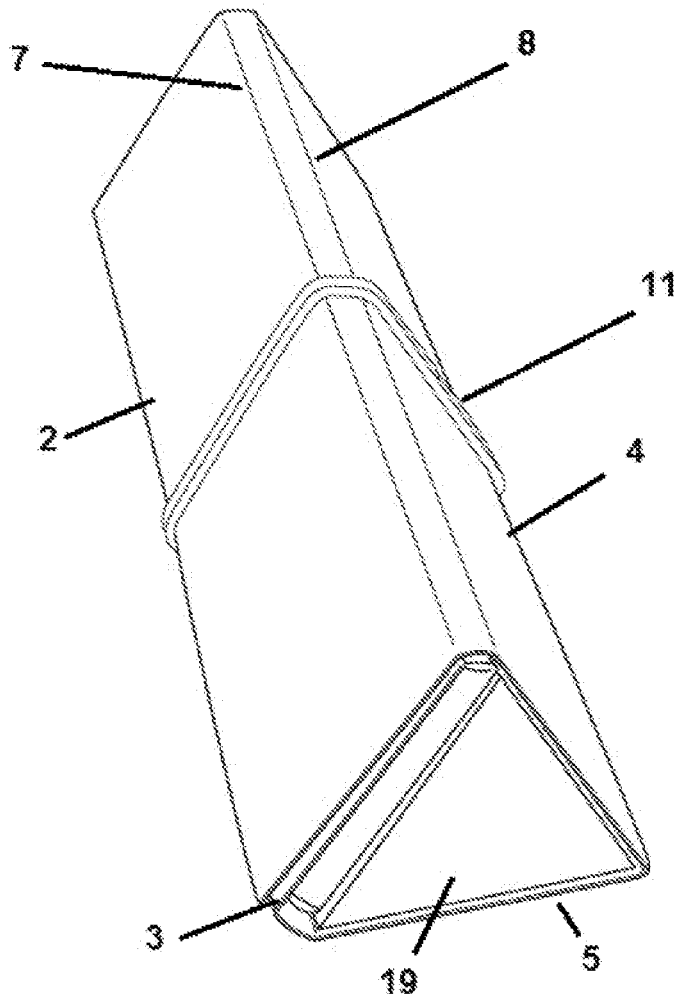
FIG. 7 is a front view of a cigarette dispenser according to one embodiment of the invention in the second configuration with the pouch sealed.

FIG. 7 is a front view of the cigarette dispenser of the invention in the second configuration with the pouch sealed. In the second configuration the structure forms a substantially triangular shaped prism. The outer surface of the prism is formed from the first cover panel 2 and the first and second inner panel 4, 5. The first cover panel 2 further folds over the second cover panel 3 to seal the pouch 14. The pouch 14 is held in a sealed configuration by the elasticated band 11.

The cigarette dispenser will now be described in use. Starting with the dispenser in the closed configuration as shown in FIGS. 1 and 2, a user decides to roll a cigarette. The dispenser is substantially flat with the first cover panel 2, first inner panel 4, second inner panel 5 and second cover panel 3 overlaying each other in a stacked formation. The elasticated band it may be first unwrapped from about the structure 1 of the dispenser. The structure 1 may be unfolded such that the first and second inner panels 4, 5 are separated or unstacked by opening the first foldable hinge 6. The first cover 2 is separated or unstacked from the first inner panel 4 by unfolding along the second foldable hinges 7, 8. The second cover 3 is separated or unstacked from the second inner panel 5 by unfolding along the third foldable hinges 9, 10. The structure now forms a substantially "M" shaped profile. From the underside of the first inner panel 4, the user may remove a cigarette tip 12 and from the underside of the second inner panel 5, the user may remove a rolling paper from the dispensing means 13. The user may then place the structure 1 on a surface with the first and second cover panels 2, 3 and the first and second inner panels 4, 5 facing upwards towards the user forming a tray as in FIG. 3. The elasticated band 11 may be stretched and hooked over a corner of the first cover panel 2. With the dispenser in this position, the user may lay the rolling paper with its bisecting fold nested in the fold between the first and second inner panels formed by the first foldable hinge 6. The rolling paper is thus stably held between the inner panels 4, 5.

Tobacco or other substances may be placed along the rolling paper to the preference of the user and the paper may be wrapped and sealed by the user with a cigarette tip 12 added as desired. The cigarette is now rolled, however, the user may not wish to smoke the cigarette immediately and instead may wish to store the rolled cigarette for later use. In this instance, the structure 1 may be turned over as shown in FIGS. 4 and 5 and the pouch 14 may be opened by the user as shown in FIG. 6. The pouch may be opened by releasing a clasp (not shown), for example a magnetic clasp. Releasing the clasp exposes two foldable collars 16, 17, one at each end of the pouch 14. The collars 16, 17 are foldable along axes extending from points A, B and C such that each collar is foldable from a flat configuration, with the collar against the inner panel 5, to an upright configuration in which the collars form end walls 18, 19 for the pouch. It can be seen from FIG. 6, that folding the collars to the upright configuration, creates a void 15 or space into which the rolled cigarette can be placed for safe carriage. Once the cigarette is placed in the void 15 of the pouch 14, the pouch may be closed. To close the pouch 14, the first inner panel 4 is folded towards the pouch 14 such that the panel side comprising the cigarette tips 12 covers the void 15 of the pouch 14. The second outer cover 3 may be folded towards the pouch, and the first outer cover 2 may be folded to overlap the second outer cover 3. Thus, the structure now forms a triangular prism with the rolled cigarette held in the void 15 formed by the foldable pouch collars 16, 17 and sealed by the second inner panel 5. Once again, the elasticated band 11 may be used to seal the structure in this configuration by wrapping the band around the panels as shown in FIG. 7. The cigarette may now be carried safely as the prism shape provides a robust defense against crushing.

To retrieve the cigarette, the elasticated band 11 can be unwrapped and the first cover panel 2 and first inner panel 4 unfolded to allow the user access the pouch 14. The collars 16, 17 may be returned to their flat configuration, the pouch may be clasped shut and the first and second cover panels 2, 3 may be folded flat as per FIG. 1 and FIG. 2.

The words "comprises/comprising" and the words "having/including" when used herein with reference to the present invention are used to specify the presence of stated features, integers, steps or components but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

What is claimed is:

1. A cigarette paper dispenser comprising:

(a) a plurality of panels and a plurality of hinge lines, wherein (i) each panel is adjoined to at least one other panel along at least one hinge line, (ii) the plurality of panels comprises at least a first cover panel and a second cover panel and at least a first inner panel and a second inner panel, (iii) the first inner panel is adjoined to the second inner panel along a first foldable hinge line along a length of panels, (iv) the first inner panel is adjoined to the first cover panel along a second foldable hinge line along the length of the panels, and the second inner panel is adjoined to the second cover panel along a third foldable hinge line along the length of the panels, and wherein (v) the panels are foldable along the hinge lines between a first configuration and a second configuration, wherein (A) in the first configuration the plurality of panels defines a tray where side edges of the plurality of panels that are transverse to the foldable hinge lines define a substantially "M" shaped profile, and wherein (B) in the second configuration, the plurality of panels define an enclosure that defines a substantially triangular shaped prism and that is sized to accommodate a rolled cigarette.

2. The cigarette paper dispenser of claim 1 further comprising a pouch disposed on one of the plurality of panels, wherein the pouch is foldable between: (a) a closed configuration, wherein the pouch is substantially flat, and (ii) an open configuration that defines a void sized to accommodate a rolled cigarette.

3. The cigarette paper dispenser of claim 1 further comprising a pouch disposed on one of the plurality of panels, wherein the pouch is foldable between: (a) a closed configuration, wherein the pouch is substantially flat, and (ii) an open configuration that defines a void sized to accommodate a rolled cigarette.

4. The cigarette paper dispenser of claim 3, wherein the pouch comprises a pair of foldable collars which are substantially flat in the closed configuration and form end walls of the pouch in the open configuration.

5. The cigarette paper dispenser of claim 4, wherein with the pouch in the open configuration, the plurality of panels are foldable about the pouch to enclose the void.

6. The cigarette paper dispenser of claim 3, wherein the pouch comprises a magnetic clasp that secures the pouch in the closed configuration.

7. The cigarette paper dispenser of claim 5, wherein the pouch comprises a magnetic clasp that secures the pouch in the closed configuration.

8. The cigarette paper dispenser of claim 1 further comprising an elasticated element secured to one of the plurality of panels, wherein when the plurality of panels are in the second configuration, the elastic element is sized to extend about an outer surface of the plurality of panels and engage the outer surface to secure the panels in the second configuration.

* * * * *